United States Patent [19]

Landert et al.

[11] 4,076,215

[45] Feb. 28, 1978

[54] ELECTROHYDRAULIC DRAWING APPARATUS, PARTICULARLY A HOIST

[75] Inventors: Heinrich Landert; Wolfgang Radau, both of Bulach; Ernst Kuhn, Embrach, all of Switzerland

[73] Assignee: Landert - Motoren A.G., Bulach, Switzerland

[21] Appl. No.: 748,387

[22] Filed: Dec. 7, 1976

[30] Foreign Application Priority Data

Dec. 15, 1975 Switzerland ..... 16225/75

[51] Int. Cl.[2] ..... B66F 3/24

[52] U.S. Cl. ..... 254/93 R

[58] Field of Search ..... 254/93 R, 150 FM; 60/474; 29/252; 294/82 R

[56] References Cited

U.S. PATENT DOCUMENTS

| | | | |
|---|---|---|---|
| 804,510 | 11/1905 | Vaughan | 254/93 R |
| 1,690,181 | 11/1928 | Sederholm | 254/93 R |

*Primary Examiner*—Robert C. Watson

*Attorney, Agent, or Firm*—Haseltine, Lake & Waters

[57] ABSTRACT

An electrohydraulic drawing or hoisting apparatus for the pulling or lifting and lowering of loads, in which a load lifting member, hydraulic fluid tank, electric motor, pump, and control unit are all mounted within a single compact unit which is rigidly connected to one end of a cylinder piston unit. A control handle is connected to the hydraulic control unit so that the directions of displacement of the handle and the resulting motion of the load lifting member coincide substantially. The speed of the piston in both directions is continuously variable as a function of the displacement of the control handle. The piston's speed in at least one direction of motion, moreover, is controlled by influencing the pump delivery through displacement of the control handle. A lift ring of a vane cell pump is coupled through a connecting linkage with the control handle for influencing the pump delivery, so that zero lift position of the ring corresponds to initial or rest position of the control handle, and pump delivery flow in at least one direction corresponds to a displacement of the control handle. The pump delivery flow causes motion of the load lifting member in direction of this displacement.

10 Claims, 13 Drawing Figures

ELECTROHYDRAULIC DRAWING APPARATUS, PARTICULARLY A HOIST

BACKGROUND OF THE INVENTION

The present invention relates to an electrohydraulic drawing apparatus, particularly a hoist, for pulling or lifting and lowering loads, comprising a cylinder piston unit, a hydraulic fluid tank, a pump coupled to an electric motor and connected to the cylinder piston unit, control means for the electrical and hydraulic control of the drawing apparatus, and a load lifting member.

Small hoist of this species are already known in the art. With simple, economical electromechanical designs, the lift and lowering speed is nearly constant or selectable in two stages by pole reversal of the motor. Pneumatic hoists or balancers permit a continuously variable speed regulation, but produce a greatly annoying noise or have the disadvantage that the load tends to vibrate due to the compressibility of the air. Hydraulic devices permit a continuously variable adaptation of the speed, as well as a sensitive and accurate positioning of the load, but their known designs are relatively complex and therefore expensive.

It is, therefore, an object of the present invention to provide a simple and economical hoist where the load sensitively follows the vertical motions of a controlling hand.

Another object of the present invention is to provide apparatus of the foregoing character which may be readily maintained in service and has a substantially long operating life.

SUMMARY OF THE INVENTION

The objects of the present invention are achieved by combining the hydraulic fluid tank, the electric motor, the pump, the control unit and the load lifting member in one compact unit rigidly connected to one end of the cylinder piston unit.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
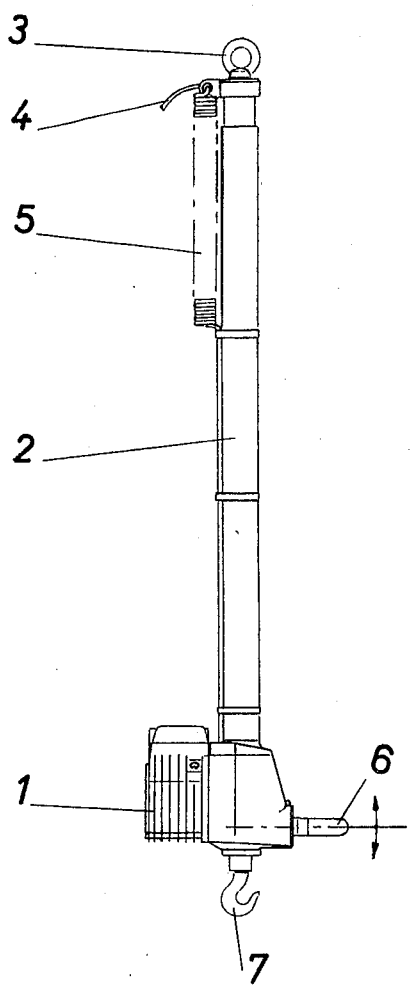
FIG. 1 shows a side view of a drawing apparatus designed as small hoist.
Figure 2:
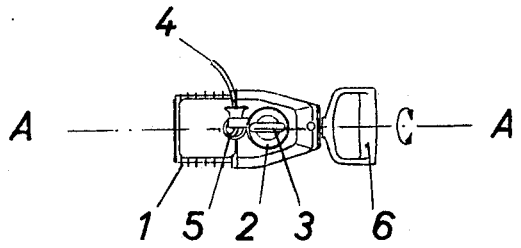
FIG. 2 shows a top view of the drawing apparatus of FIG. 1.

Referring to FIGS. 1 and 2, the drawing apparatus comprises a motor pump unit 1 and a cylinder piston unit 2 which are rigidly connected with each other. It is suspended by means of a suspension eye 3 from a fastening location (not shown), as for example, a crane trolley. The power supply from the line comes via a power supply cable 4 which, to compensate for length changes of the cylinder piston unit 2 during lifting and lowering is coiled in a spiral 5. The apparatus is controlled electrically and hydraulically by a handle 6. The load is held by a load hook 7.

The motor pump housing 1 (FIG. 1), is filled with a hydraulic fluid 8 (FIG. 3), comprises a motor housing 9 (FIG. 3), a pump housing 10, a connecting flange 11 and a cover plate 12 which all are threaded together in an oiltight manner. A connecting flange 13 threaded onto the pump housing 10 mounts the load hook which is made rotatable by a thrust bearing 14. The power supply cable 4 passes through a gland 15 into a terminal box 16 which is covered by a terminal box cover 17. The stator 19 of the electric motor is pressed into the motor housing 9 which has cooling fins 18; its rotor 20 is mounted on a bearing 21. A pump body 22, threaded onto the motor housing 9, of a vane cell pump mounts a second bearing 23 of a common motor pump shaft 24.

Figure 5:
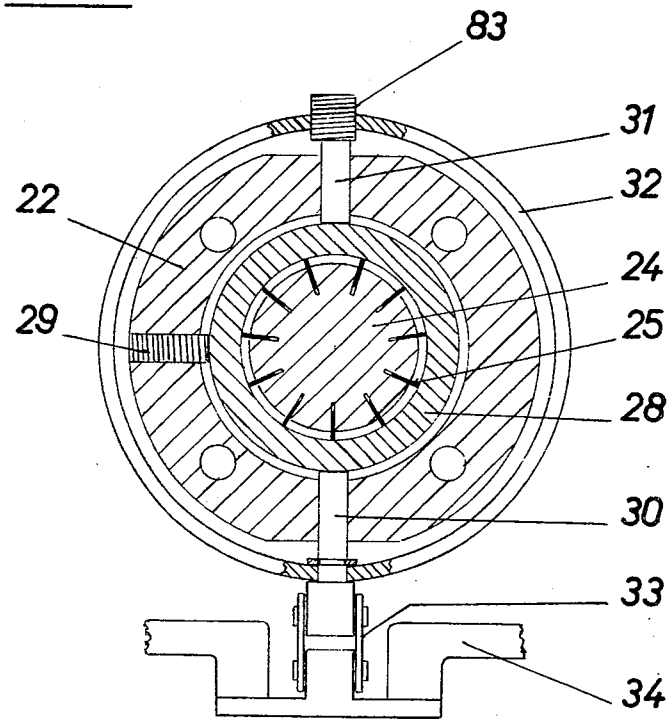
FIG. 5 shows a detail section of enlarged scale taken along line B — B of FIG. 3.
Figure 7:
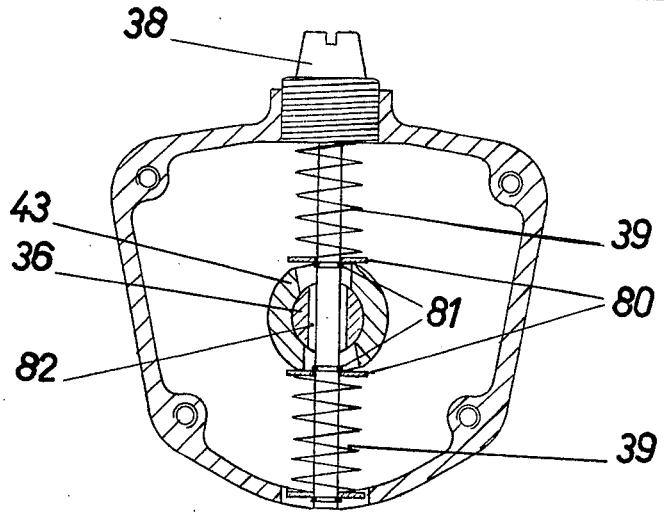
FIG. 7 shows a detail section of enlarged scale taken along line D — D of FIG. 3.

The motor pump shaft 24 is constructed, in a manner already known in the art, as the rotor of a vane cell pump, and mounts vanes 25 (FIG. 5). The pump body 22 also mounts a sealing plate plate 26 (FIG. 3) and a control plate 27. A lift ring is held on the side by a support screw 29 (FIG. 5) and can be displaced from the zero-displacement position shown by means of two support bolts 30 and 31. The support bolts 30 and 31 are rigidly connected to each other by means of a control ring 32 and are flexibly connected to a control yoke 34 via butt straps 33; an adjustment thread 83 with a screw-locking device (not shown) permits adjustment free from backlash of the lift-ring guideway.

The control yoke 34 (FIG. 3) is pivotable about a shaft 35 on motor housing 9. The control yoke 34 mounts control handle 6 ove carrying bolt 36. A bellows 37 seals the housing 10 even when the control handle is moved and prevents leakage of pressure fluid 8.

Pressure springs 39, mounted on a control screw 38 are adjusted by means of a thread 84 such that, with no load on the handle 6, the lift ring 28 of the vane cell pump is in the zero lift position shown; as a result, it does not deliver any oil even if the rotor 20 of the electric motor is running. To ensure a perfect zero position of control handle 6, which is definitely independent from friction, the pressure springs 39 are pretensioned independent of each other. Half-moon rings 81 inserted into ring grooves of the control screw 38 are of small diameter, the washers 80 holding the springs 39 are larger than the bore 82 of control handle 6. When moving the control handle 6 upwards, for example, the upper of the springs 39 acts with full initial stressing force in the direction of return to the zero position while the lower spring 39, due to being held by washers 80 and half-moon rings 81 cannot exert a counterforce on the control handle 6 as long as the latter is shifted upwards of the zero position. The spacings of the annular grooves for the half-moon rings 81 are chosen so that the control handle 6 in the zero position is as backlash-free as possible between the washers 80 pressed by the springs 39 on the half-moon rings 81.

If the control handle 6 is moved upward manually, via the mechanical connection shown, there results an approximately proportional displacement of the lift ring and therefore, with the pump running, an approximately proportional increase of the pump delivery whereupon, in a manner shown subsequently, the motor pump housing moves upward till either the control handle 6 is returned to its zero position or the piston cylinder unit 2 (FIG. 2) reaches its upper stop. Hence the arrangement described provides that during lifting, the load suspended from the load hook 7 sensitively follows the lifting motion of the hand holding the control handle 6 with continuously variable speed.

Figure 8:
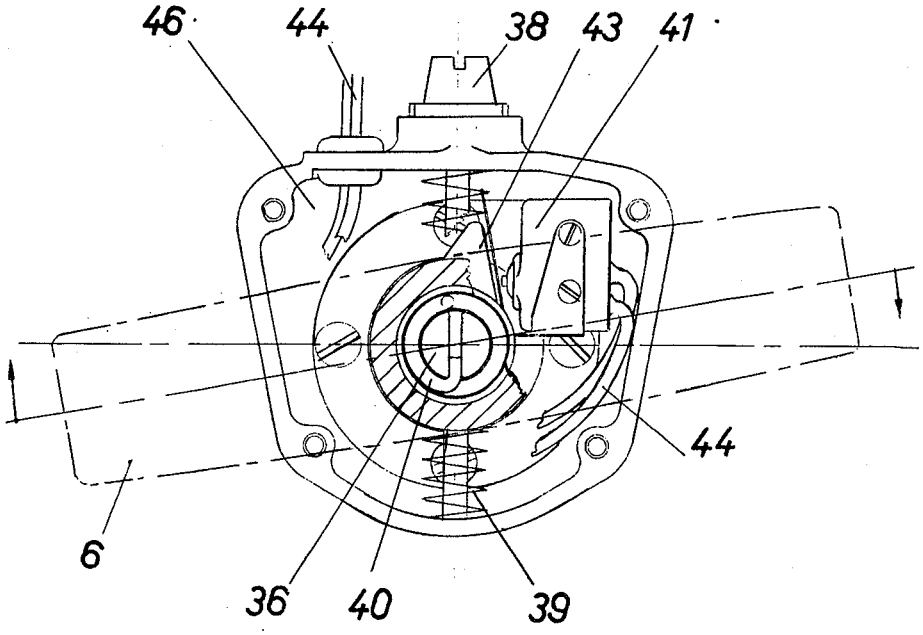
FIG. 8 shows a detail section taken along line E — E of FIG. 3.

In the rest position drawn in FIG. 8, the handle 6 which is mounted rotatably on the carrying bolt 36 is slightly tilted under the influence of a spring. As a result of this, a limit switch 41 controlling the motor is shut off. If the control handle 6 is held by the operator, he turns the handle, to switch on the apparatus, into the more handy or convenient horizontal position. As a result, the limit switch 41 is actuated over a cam 43. The limit switch 41 is connected via a cable 44 to a control relay 45 mounted in the terminal box 16 (FIG. 3) and connects, in a manner known in the art, the winding of stator 19 with the electrical line power, and thus sets motor and pump into operation. The electrical and hydraulic control is achieved through the same control handle 6 by using its first degree-of-freedom "turning" for switching the motor on and off, and its second degree-of-freedom "lifiting/lowering" for the hydraulic control.

Figure 3:
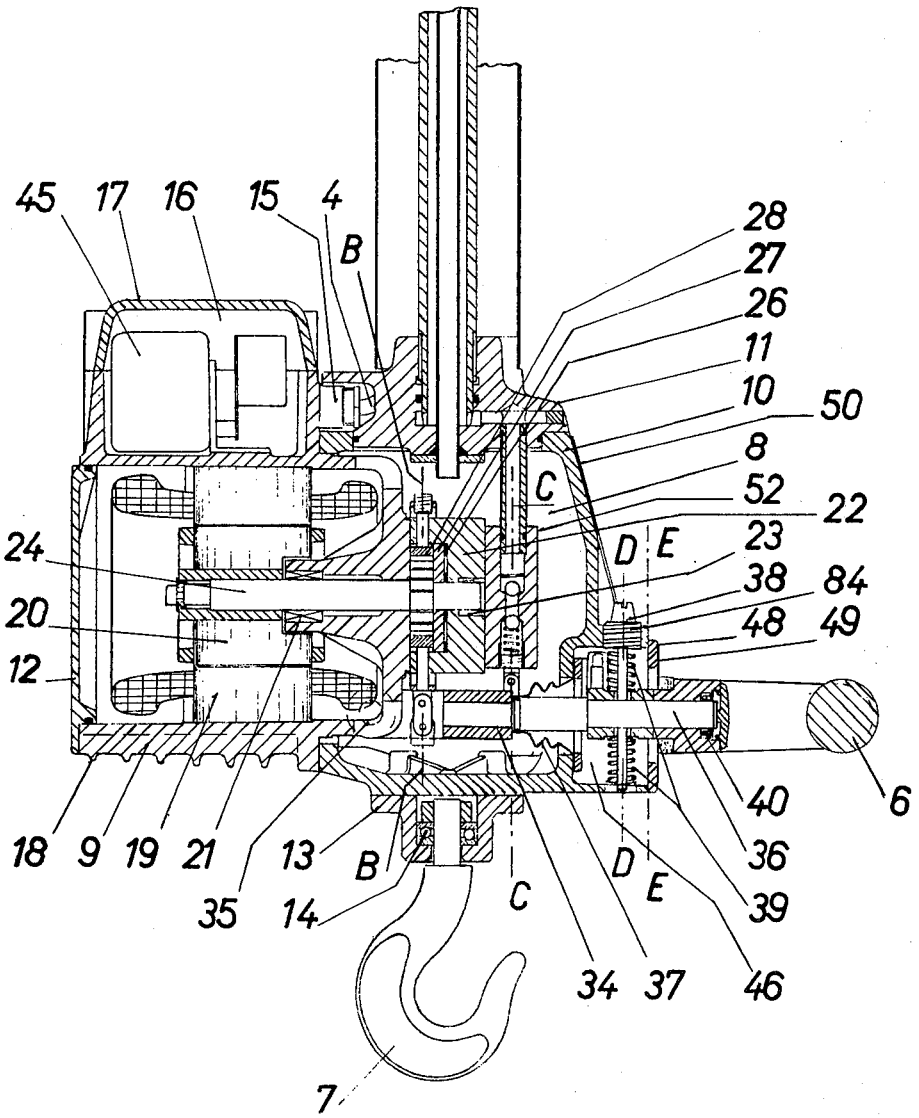
FIG. 3 shows a cross section taken along line A — A of FIG. 2 through the lower portion of the drawing apparatus.

The limit switch 41 (FIG. 8) and the ramaining parts located in a control cavity 46 are protected against interference and damage by a movable cover 48, 49 (FIG. 3). After passing out of the control cavity 46, the control cable 44 is covered by a nameplate 50 and during its way to the terminal box 16, it is covered by the connecting flange 11, and thus it is protected against damage.

Figure 4:
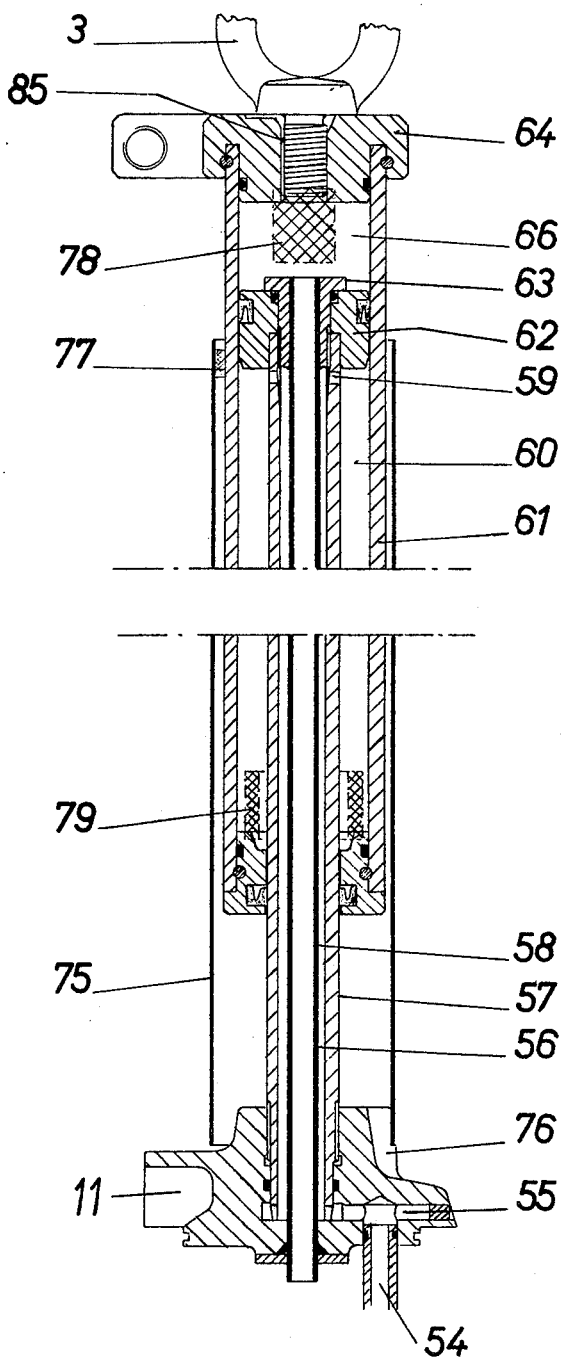
FIG. 4 shows the same section through the upper portion of the drawing apparatus.
Figure 6:
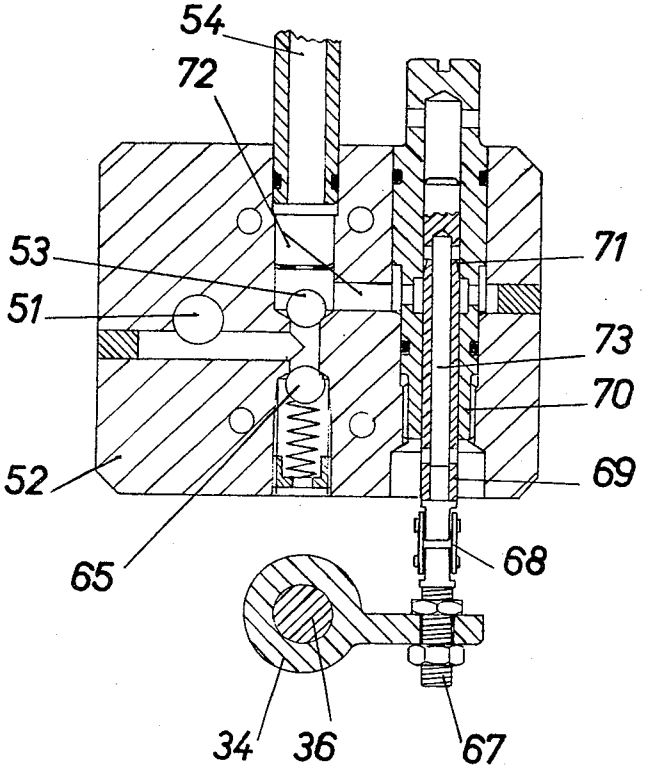
FIG. 6 shows a detail section of enlarged scale taken along line C — C of FIG. 3.

The surge chamber of the vane cell pump is connected, via boreholes 51 (FIG. 6) in a valve plate 52 screw-fastened to the pump body 22, a connecting pipe 54, boreholes 55 (FIG. 4) of the connecting flange 11, an annular cavity 56 between a hollow piston rod 57 and a return 58 and boreholes 59, to the pressure side 60 of a lift cylinder 61 in which a piston connected to the piston rod 57 is located. If the pump delivers hydraulic fluid, the piston 62 is moved upward and, by means of the piston rod 57 threaded to a piston box 63 and the connecting flange 11, pulls the motor pump housing 1 (FIG. 1) with the attached load hook 7 and the load upward. If the lift motion is limited by the piston box 63 (FIG. 4) hitting a cylinder head 64, the hydraulic fluid delivered by the pump returns to the tank 8 via a pressure limiting valve 65 (FIG. 6).

An upper cylinder volume 66 (FIG. 4) is connected to the tank 8 (FIG. 3) via the return pipe 58 so that it also is available as hydraulic fluid storage tank and is used for the volume balancing during the retraction and extension of the piston rod, and for the temperature-related volume change of the hydraulic fluid; at its highest point, it is connected via a groove 85 with the outside. Both ends of the cylinder 61 have elastic inserts 78 and 79 which prevent a hard impact of the piston 62 or of the piston box 63.

For lowering the apparatus, analogous with the lifting process, the handle 6 (FIG. 3) is moved downwards by the operator. Via carrying bolt 36 in the control yoke 34, an adjustment screw 67 (FIG. 6) and a joint plate connection 68, a lowering control piston 69 in a control box 70 threaded into the control plate 52 is pulled downward. As a result, control slots 71 clear a flow cross section which increases as the handle is further displaced. Consequently, the hydraulic fluid can flow from the pressure tank 60 (FIG. 4) through the boreholes 59, the annular space 56, the boreholes 55, the connecting pipe 54 (FIG. 6) and additional boreholes 72, 73 into the storage tank 8. As a result, when lowering, the load on the load hook sensitively follows the motion of the hand holding the control handle 6 with continuously variable speed.

A protective pipe 75, centered on cams 76 (FIG. 4) of the connecting flange 11 holding the lift cylinder 61 by means of inserts 77, protects the piston rod 57 against dirt and damage during rough shop operation.

The motor winding of stator 19 (FIG. 3) is protected in a conventional manner by temperature sensors against overheating.

Figure 9:
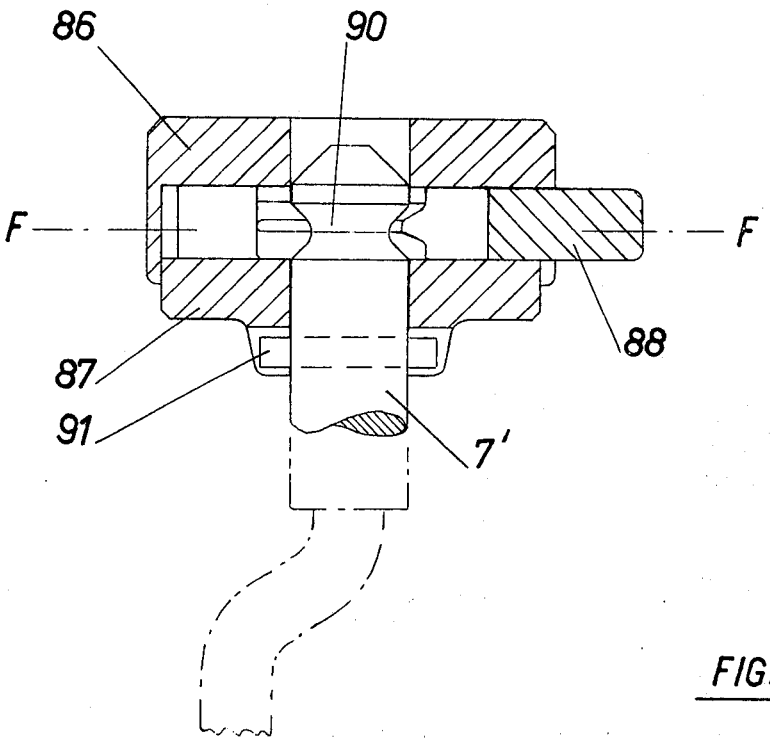
FIG. 9 shows a detail section through a quick-change coupling for the load lifting member.
Figure 10:
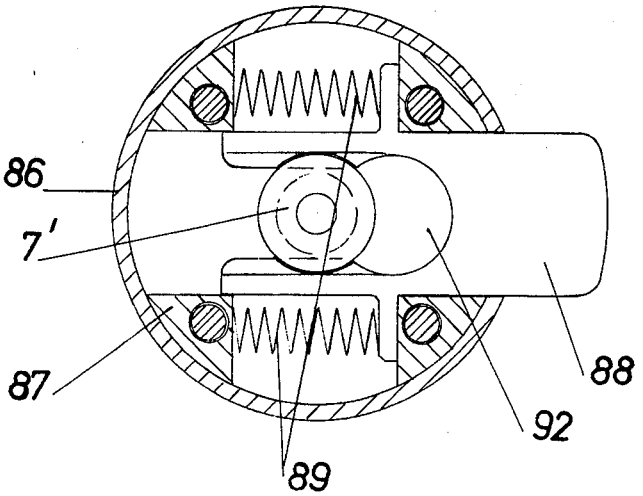
FIG. 10 shows a detail section taken along line F — F of FIG. 8.

FIGS. 9 and 10 show, as a design variation, instead of parts 13, 14 (FIG. 3), a quick-change coupling for quickly changing the load lifting member 7.

An intermediate flange 86 and a flange 87 are threaded to the pump housing 10 and together carry a slide 88 which is pushed by springs 89 into the position shown. In this position, it continues to be secured by a collar 90, engaging a suitable recess, of the load lifting member 7 which is secured against twisting by a bolt 91. For exchanging the load lifting member, such as hook, yoke, grapler, etc., it must be pushed upward so far that the collar 90 disengages from the recess in the slide 88; the latter may be pushed in against the action of the spring 89 so far that the load lifting member 7 may be pulled out downward through a borehole 92. To insert the load lifting member provided with a suitably shaped trunnion 7', the slide 88 must first be pushed in, the trunnion 7' must be inserted all the way, the slide and then the load lifting member must be released; under its own weight, the load lifting member engages the recess of the slide 88 and secures it against unwanted displacement.

Figure 12:
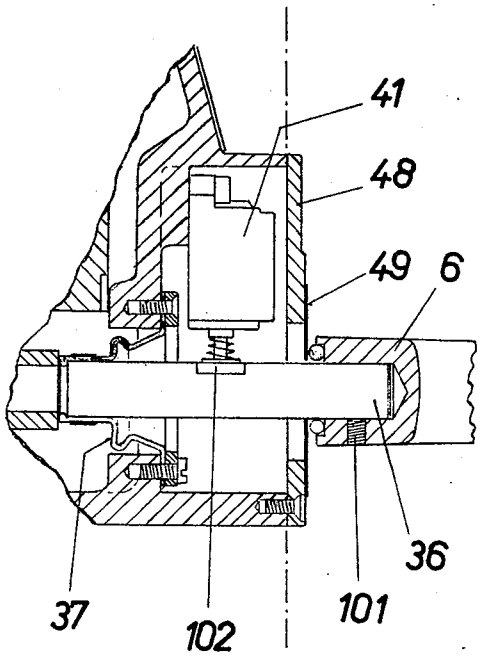
FIG. 12 shows a partial cross section of the embodiment of FIG. 11 in accordance with FIG. 3.
Figure 11:
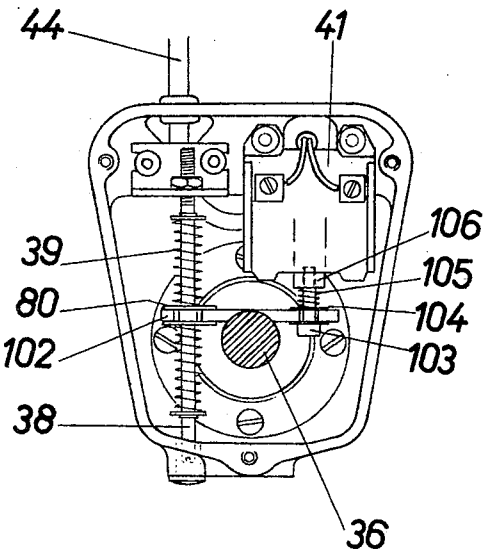
FIG. 11 shows a detail section of a simplified embodiment in accordance with FIG. 8.

FIGS. 11 and 12 show a simplified embodiment of the electrical control arrangement for the pump motor. Deviating from the embodiment already described by FIG. 8, the limit switch 41 which controls the motor is actuated not by turning, but by merely lifting the control handle 6. As is evident from 12, the control handle 6 is no longer rotatably mounted on the carrying bolt 36, but is fixed on it by means of a worm screw 101. A traverse 102, connected rigidly to carrying bolt 36 in a manner not shown, is held in the middle position shown by the washers 80 under the action of springs 39, with the springs 39 being again located on the control screw 38 (FIG. 11). On the other side, the traverse 102 is connected via a screw 103, a washer 104 and a spring 105 to a trip cam 106 of limit switch 41. The remaining parts, as for example, the bellows 37, the slidable covers 48, 49 and the control cable 44 of the limit switch are the same as the embodiments described in conjunction with FIGS. 3 and 8.

In the middle position shown, the limit switch 41 is switched off. If the control handle 6 is moved upward, it is switched on via the connection 103, 104 shown; due to spring 105, the path of the control handle 6 is not restricted in the upward direction by the travel of the limit switch 41. When moving the control handle 6 downwards, the trip cam 106 is pulled downward via the mentioned connection 103, 104, and the contacts of limit swtich 41 are necessarily separated.

Figure 13:
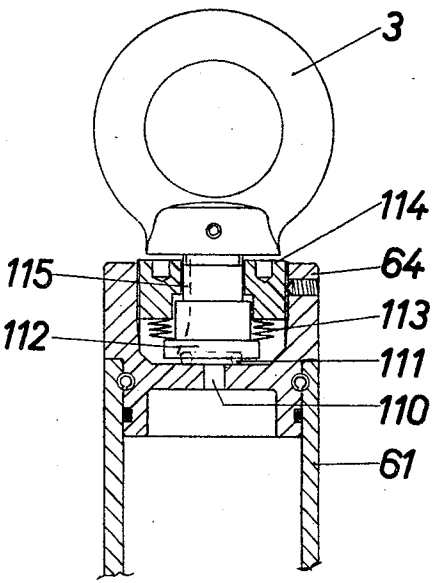
FIG. 13 shows a section through the upper portion of another embodiment of the drawing apparatus as shown in FIG. 4.

FIG. 13 shows another embodiment of the upper end of the cylinder piston unit (FIG. 4) which avoids unwanted leakage of the hydraulic fluid during transport of the drawing apparatus. In this embodiment, the lift cylinder 61 is vented via a borehole 110 which is closed in the rest position shown by an O-ring 111 and a trunnion 112 under the action of cup springs 113 so that the drawing apparatus can be transported in any position without danger of leakage of hydraulic fluid. If the apparatus is suspended for normal operation on the suspension eye 3 connected to the trunnion 112, the weight of the apparatus pulls a nut 114 belonging to the cylinder head 64 downward till it hits a stop. This opens borehole 110, so that a pressure balancing occurs via a groove 115 provided in the portion connecting trunnion 112 to the eye ring 3.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalents of the following claims.

What is claimed is:

1. An electrohydraulic drawing apparatus, particularly a hoist for pulling or lifting and lowering loads comprising: a cylinder piston unit; a hydraulic fluid tank; a pump coupled to an electric motor and connected to said cylinder piston unit; control means for electrical and hydraulic control of the drawing apparatus; a load lifting member; control handle means connected to said control means, said control handle means having displacement directions coinciding substantially with motion of said load lifting member; said piston unit has a speed continuously variable in two directions as a function of the displacement of said control handle means; and said hydraulic fluid tank, said electric motor, a pump, said control means and said load lifting member comprising one compact unit rigidly connected to one end of said cylinder piston unit.

2. The drawing apparatus as defined in claim 1 including; control means for controlling the delivery of said pump by displacement of said control handle means to thereby vary the speed of said piston unit in at least one direction of motion.

3. The drawing apparatus as defined in claim 2 including a lift ring on said pump and connected by linkage means to said control handle means for influencing pump delivery, said pump being a vane cell pump, zero lift position of said lift ring means corresponding to neutral position of said control handle means, pump delivery flow in at least one direction corresponding to a displacement of said control handle means, pump delivery flow applying motion to said load lifting member in direction of displacement of said control handle means.

4. The drawing apparatus as defined in claim 1 including two independently preloaded springs for determining a neutral position of said control handle means.

5. The drawing apparatus as defined in claim 4 including adjusting means linked to said control handle means for adjusting the neutral position of said control handle means.

6. The drawing apparatus as defined in claim 1 including a hollow piston rod rigidly connected to a housing of said motor pump, said cylinder unit having a surge chamber, hydraulic fluid being supplied to said surge chamber through said hollow piston rod.

7. The drawing apparatus as defined in claim 6 wherein said hollow piston rod has a return pipe connecting another side of said cylinder unit with the interior of said housing of said motor pump, the interior of said housing being free of pressure.

8. The drawing apparatus as defined in claim 6 including connecting opening means for balancing outside air against volume changes in said hydraulic fluid tank, said connecting opening means being in proximity to a cylinder head on the opposite side of said motor pump housing.

9. The drawing apparatus as defined in claim 8 including spring loaded rod means for closing said connecting opening means; means for hanging up said drawing apparatus, said rod means being connected with said hanging up means so that the weight of the hanged up drawing apparatus lifts off said rod means from said connecting opening means.

10. The drawing apparatus as defined in claim 6 including protective pipe means centered on an outside wall of said cylinder unit and on a housing of said motor pump for protecting against damage to the piston rod when extended.

* * * * *